US008459367B2

(12) United States Patent
Nutley et al.

(10) Patent No.: US 8,459,367 B2
(45) **Date of Patent: *Jun. 11, 2013**

(54) SWELLABLE PACKER HAVING A CABLE CONDUIT

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/337,833

(22) Filed: Dec. 27, 2011

(65) Prior Publication Data

US 2012/0168160 A1 Jul. 5, 2012

Related U.S. Application Data

(63) Continuation of application No. 12/393,938, filed on Feb. 26, 2009, now Pat. No. 8,083,000.

(30) Foreign Application Priority Data

Mar. 4, 2008 (GB) ..... 0804029.7
Jul. 30, 2008 (GB) ..... 0813879.4

(51) Int. Cl.
*E21B 33/12* (2006.01)

(52) U.S. Cl.
USPC ..... 166/387; 166/188; 166/195; 166/242.2; 166/242.3

(58) Field of Classification Search
USPC ..... 166/385, 387, 242.3, 188
See application file for complete search history.

(56) References Cited

U.S. PATENT DOCUMENTS

| | | | |
|---|---|---|---|
| 56,234 | A | 7/1866 | Latham |
| 2,945,541 | A | 10/1955 | Maly et al. |
| 3,899,631 | A | 8/1975 | Clark |
| 6,173,788 | B1 | 1/2001 | Lembcke et al. |
| 7,431,082 | B2 | 10/2008 | Holt et al. |
| 7,611,339 | B2 | 11/2009 | Tetzlaff et al. |
| 7,762,322 | B2 | 7/2010 | Andersen et al. |
| 7,836,960 | B2 | 11/2010 | Patel et al. |

(Continued)

FOREIGN PATENT DOCUMENTS

| | | | |
|---|---|---|---|
| WO | 2004057715 | A2 | 7/2004 |
| WO | WO 2004057715 | A2 * | 7/2004 |
| WO | 2005090843 | A1 | 9/2005 |
| WO | WO 2005090743 | A1 * | 9/2005 |

OTHER PUBLICATIONS

UK Search Report regarding corresponding application No. GB0813879.4, dated Aug. 13, 2008; 5 pages.

(Continued)

*Primary Examiner* — Jennifer H Gay
(74) *Attorney, Agent, or Firm* — Wong, Cabello, Lutsch, Rutherford & Brucculeri, LLP

(57) ABSTRACT

An apparatus and assembly create a seal in a wellbore around a cable or line. The assembly includes a longitudinal body and a swellable portion which comprises a material selected to increase in volume on exposure to at least one triggering fluid. The swellable portion has a formation open to the longitudinal surface of the body which provides a pathway for a cable or line to extend through the swellable portion, and an insert of swellable material. The insert may partly or fully enclose or encapsulate the cable or line. a formation which is open to an outer longitudinal surface of the body.

39 Claims, 10 Drawing Sheets

U.S. PATENT DOCUMENTS

| | | | | |
|---|---|---|---|---|
| 7,896,070 | B2 | 3/2011 | Lovell | |
| 8,083,000 | B2 * | 12/2011 | Nutley et al. | 166/387 |
| 2007/0012436 | A1 | 1/2007 | Freyer | |
| 2007/0046115 | A1 | 3/2007 | Tetzlaff et al. | |
| 2007/0158060 | A1 * | 7/2007 | Baaijens et al. | 166/65.1 |
| 2009/0173505 | A1 | 7/2009 | Patel et al. | |
| 2009/0250228 | A1 | 10/2009 | Loretz et al. | |
| 2009/0277652 | A1 | 11/2009 | Nutley et al. | |
| 2009/0283254 | A1 | 11/2009 | Andersen et al. | |
| 2010/0065284 | A1 | 3/2010 | Freyer | |
| 2010/0230094 | A1 | 9/2010 | Foster et al. | |
| 2011/0056706 | A1 | 3/2011 | Brooks | |

OTHER PUBLICATIONS

"open", http://www.merriam-webster.com/dictionary/open, dated 2011, 5 pages.

* cited by examiner

SWELLABLE PACKER HAVING A CABLE CONDUIT

CROSS REFERENCE TO RELATED APPLICATIONS

This application is a continuation of U.S. patent application Ser. No. 12/393,938, filed Feb. 26, 2009, now U.S. Pat. No. 8,083,000, which claims the benefit of United Kingdom Patent GB0804029.7, filed on Mar. 4, 2008, both of which hereby are incorporated by reference in their entirety.

FIELD OF THE INVENTION

The present invention relates to apparatus for use downhole or in pipelines, and methods of use, in particular in the field of oil and gas exploration and production. The invention also relates to components for and methods of forming a downhole apparatus.

BACKGROUND

This application claims the benefit of United Kingdom Patent Application No. GB0804029.7, filed on Mar. 4, 2008, which hereby is incorporated by reference in its entirety.

In the field of oil and gas exploration and production, various tools are used to provide a fluid seal between two components in a wellbore. Isolation tools have been designed for sealing an annulus between two downhole components to prevent undesirable flow of wellbore fluids in the annulus. For example, a packer may be formed on the outer surface of a completion string which is run into an outer casing or an uncased hole. The packer is run with the string to a downhole location, and is inflated or expanded into contact with the inner surface of the outer casing or openhole to create a seal in the annulus. To provide an effective seal, fluid must be prevented from passing through the space or micro-annulus between the packer and the completion, as well as between the packer and the outer casing or openhole.

Isolation tools are not exclusively run on completion strings. For example, in some applications they form a seal between a mandrel which forms part of a specialised tool and an outer surface. In other applications they may be run on coiled tubing, wireline and slickline tools.

Conventional packers are actuated by mechanical or hydraulic systems. More recently, packers have been developed which include mantles of swellable elastomeric material formed around tubular bodies. The swellable elastomer is selected to increase in volume on exposure to at least one triggering fluid, which may be a hydrocarbon fluid or an aqueous fluid. The packer may be run to a downhole location in its unexpanded, unswollen state, where it is exposed to a wellbore fluid and caused to swell. The design, dimensions, and swelling characteristics are selected such that the swellable mantle creates a fluid seal in the annulus, thereby isolating one wellbore section from another. Swellable packers have several advantages over conventional packers, including passive actuation, simplicity of construction, and robustness in long term isolation applications. Examples of swellable packers and suitable materials are described in GB 2411918.

It is common for a cable or line to be run parallel to production tubing or another tubular in the well. The cable or line may for example be a conduit for fluids, a hydraulic control line, or may be an electrical or optical conductor which transmits power, data or a control signal. The cable will be secured to the tubing at intervals by clamps, which also provide a protective function. It will often be necessary for a cable or line to pass a packer which creates a seal in the annulus between the tubing and an outer casing. Conventionally, cable or line sections have been integrated into the packer body, with terminal connections provided above and below the packer to allow the path provided by the cable or line to be re-established. However, providing connections for cables or lines in this way has drawbacks. These include poor contact, mechanical weaknesses in the cable or line, and corrosion or leakage paths. Assembly of the packers and connection of the cable or control lines on the rig floor may also be difficult and time-consuming.

FIG. 1 of the drawings shows a swellable packer according to WO 04/057715, generally depicted at 10, formed on a tubular body 12 having a longitudinal axis L. The packer 10 comprises an expanding mantle 15 of cylindrical form located around the body 12. The expanding mantle 15 is formed from a material selected to expand on exposure to at least one predetermined fluid, and is shown here in its swollen condition. The dimensions of the packer 10 and the characteristics of the swellable material of the expanding portion 15 are selected such that the expanding portion forms a seal with a casing 19 in use, which prevents the flow of fluids past the body 12. A cable 22 extends through the packer 10 in an opening 21, and is disposed in the opening through a slit 23.

The arrangement of WO 04/057715 provides a mechanism for passing a cable or a line through a packer, but does suffer from drawbacks. Firstly, the slit is designed to be closed prior to swelling of the apparatus, and must be opened with specialised equipment which holds open a portion of the slit while the cable is disposed into the opening. This equipment requires capital expenditure, operation by trained personnel, and space on the rig floor.

In addition, to allow effective opening of the slit, the material used for the packer must be sufficiently pliable. This places limitations on the materials used, which may mean that preferred swelling materials for some well environments are not available. The slit is designed to be self-closing, but a sufficiently pliable material may not close effectively, which could leave the apparatus liable to hang up or snag on protrusions during run-in. Should the cable hang-up, it could become displaced from the slit.

The slit and opening of WO 04/057715 must be formed using special tooling, and the opening must be formed to a size corresponding to the cable or line for the particular application.

WO 05/090743 discloses a system for sealing an annular space around a control lined for an inflow control device (ICD). A seal layer has an inner surface provided with a recess for receiving a control line, and on an opposing side is provided with a slit which allows the seal layer to be opened for radial application to a tubular/

Although the tool of WO 05/090743 is a convenient way of applying a seal to a tubular, it does have limitations. The control line and its cover is placed against the tubing and extends through the sealed layer. This creates a potential leak path between the cover and the pipe, which will be maintained even after swelling of the seal layer, and which limits the isolation capabilities of the device. In addition, the integrity of the seal relies entirely on radial swelling pressure. The sealing of the layer against the pipe is dependent on sufficient force across the radius of the seal layer between the cylindrical surface of the tubular and the inner surface wellbore.

The application of the seal layer in WO 05/090743 relies on resilient deformation of the seal material. This places limitations on the materials that can be used, which may mean that preferred swelling materials for some well environments are not available. In addition, the application method relies on the resilience created by the longitudinal recess for the control line. This may create some limitations to the types of control line that can be accommodated. For example, a single control line would require a smaller recess, which may not be sufficiently large to allow deformation of the seal member around the tubular. Furthermore, there are limitations on the number of longitudinal recesses that can be provided in the seal layer, as this will affect the overall integrity of the seal and clamping force that can be applied to the device.

The provision of bores for receiving the bolts of course removes volume from the seal material and may create a potential weak point in the seal. The fastening mechanism itself also inhibits the natural swelling profile of the seal member in the vicinity of the bolt, resulting in stress and shear forces being applied to the seal. Over continued use, which may include cyclical swelling, this could introduce failure modes into the seal.

There is generally a need to provide a packer and/or an associated cable or line feedthrough method which may be manufactured and assembled more efficiently than in the case of the prior art, and which is flexible in application to a variety of wellbore scenarios.

It is amongst the aims and objects of the invention to overcome or mitigate the drawbacks and disadvantages of prior art apparatus and methods.

Further aims and objects will become apparent from the following description.

According to a first aspect of the invention there is provided an apparatus for creating a seal in a wellbore, the apparatus comprising:

a swellable portion comprising a material selected to expand on exposure to at least one predetermined fluid, wherein the swellable portion comprises a formation open to a longitudinal surface, the formation configured to provide a pathway for a cable or line to extend through the swellable portion.

The swellable portion may have an expanded condition which provides a seal in a wellbore annulus. The apparatus may comprise a longitudinal body, in which case the swellable portion may provide a seal between the longitudinal body and an outer surface. The outer surface may be the internal surface of a casing or an uncased borehole.

The formation may be configured to receive an insert. The insert may be configured to be disposed between the pathway for a cable or line and an outside surface of the swellable portion. The insert may be configured to create a seal between the pathway for the cable or line and an outer surface. Alternatively or in addition, the insert may be configured to provide a seal with the swellable portion and/or a longitudinal body of the apparatus.

The insert may at least partially enclose the cable or line in use. The insert may be configured to be disposed between the cable or line and an outside surface of the swellable portion. The insert may be configured to create a seal between the cable or line and an outer surface. Alternatively or in addition, the insert may be configured to provide a seal between the cable or line and the swellable portion and/or a longitudinal body of the apparatus.

The insert and the formation may together define the pathway for the cable or line through the swellable portion.

The insert may be configured to be coupled to a cable or line. The insert may be configured coupled to a cable or line such that the cable or line is at least partially enclosed or encapsulated.

The insert may be configured to be coupled to a cable or line prior to being received in the formation. Thus the cable or line and the insert may together be received in the formation.

The insert is preferably provided with a recess for receiving a cable or line. The recess may be dimensioned for an interference fit with a cable or line. The insert may be provided with engaging portions for coupling to a cable or line.

The insert may comprise a substantially rectangular outer profile. The outer profile may be dimensioned to be an interference fit with the formation of the swellable portion. The insert may be elongated, and may be formed to a length substantially equal to the length of the swellable portion.

The insert may comprise a main body and a pair of side walls, and may comprise a substantially u-shaped or c-shaped profile. The u-shaped or c-shaped profile may define a recess for receiving the cable or line.

The insert may be resilient and may retain the cable or line, for example by partially or fully surrounding the cable or line. The insert may comprise a clip-on member that clips around a cable or line, and may be bonded in position through the use of an adhesive or other bonding agent.

Preferably, the insert comprises a material selected to expand on exposure to at least one predetermined fluid. The insert may be formed from a material selected to have substantially the same swelling characteristics as the swellable portion. Alternatively, the insert may be formed from a material selected to differ in one or more of the following characteristics: fluid penetration, fluid absorption, swelling coefficient, swelling rate, elongation coefficient, hardness, resilience, elasticity, and density. It may be desirable for the insert to expand at a different rate to the swellable portion.

The apparatus may further comprise means for securing the insert and/or cable to the swellable portion and/or body, which may comprise a bonding agent. Alternatively, or in addition, the apparatus may comprise a mechanical attachment means for securing the insert and/or cable to the swellable portion and/or body, which is preferably an end ring. The mechanical attachment means may be clamped onto the body, and may comprise a plurality of hinged clamping members. Alternatively, the mechanical attachment means is configured to be slipped onto the body.

The apparatus may comprise an end ring having a recess for receiving the cable or line. The end ring may comprise a removable securing member which retains a cable or line extending through the recess in the end ring. The securing member may be configured to be attached to the end ring over a cable or line extending through the recess.

According to a second aspect of the invention there is provided an assembly for creating a seal in a wellbore, the assembly comprising:

a longitudinal body;

a swellable portion formed on the body, the swellable portion comprising a material selected to expand on exposure to at least one predetermined fluid and having a formation providing a pathway for a cable or line to extend through the swellable portion;

and an insert configured to be received in the formation.

The apparatus of the second aspect of the invention may include one or more features of first aspect or its preferred embodiments.

According to a third aspect of the invention there is provided a method of forming a downhole apparatus, the method comprising the steps of:

(a) Providing a swellable portion on a longitudinal body, the swellable portion comprising a material selected to expand on exposure to at least one predetermined fluid;

(b) Providing an open formation in a longitudinal surface of the swellable portion, the open formation configured to receive a cable or line.

The method may include the additional step of providing a cable or line in the formation.

The method may include the additional step of providing an insert in the formation.

The method may include the step of coupling an insert to a cable or line and providing the combined insert and cable or line in the formation.

According to a fourth aspect of the invention, there is a provided a method of forming a seal in a downhole environment, the method comprising the steps of:

(a) Providing an apparatus in accordance with the first aspect of the invention or an assembly in accordance with a the second aspect of the invention;

(b) Running the apparatus or assembly to a downhole location;

(c) Exposing the swellable portion to a wellbore fluid to expand the swellable portion and create a seal.

The apparatus or assembly may comprise an insert, the insert comprising a material selected to expand on exposure to at least one predetermined fluid, and the method may comprise the additional step of exposing the insert to a wellbore fluid to expand the insert.

The method of the third or fourth aspects of the invention may include one or more features of first or second aspects or its preferred embodiments.

According to a fifth aspect of the invention there is provided an apparatus for providing a seal in a wellbore, the apparatus comprising: a longitudinal body; a swellable portion formed on the body, the swellable portion comprising a material selected to expand on exposure to at least one predetermined fluid and having a formation providing a pathway for a cable or line to extend through the swellable portion; wherein the formation is a longitudinal recess open to the outer surface of the swellable portion.

The recess may be open to the outer surface in an unswollen condition of the swellable portion. The recess may accommodate an insert. Embodiments of the fifth aspect of the invention may include preferred and optional features of any of the first to fourth aspects of the invention, and/or features of the appended claims.

DETAILED DESCRIPTION

Figure 1:
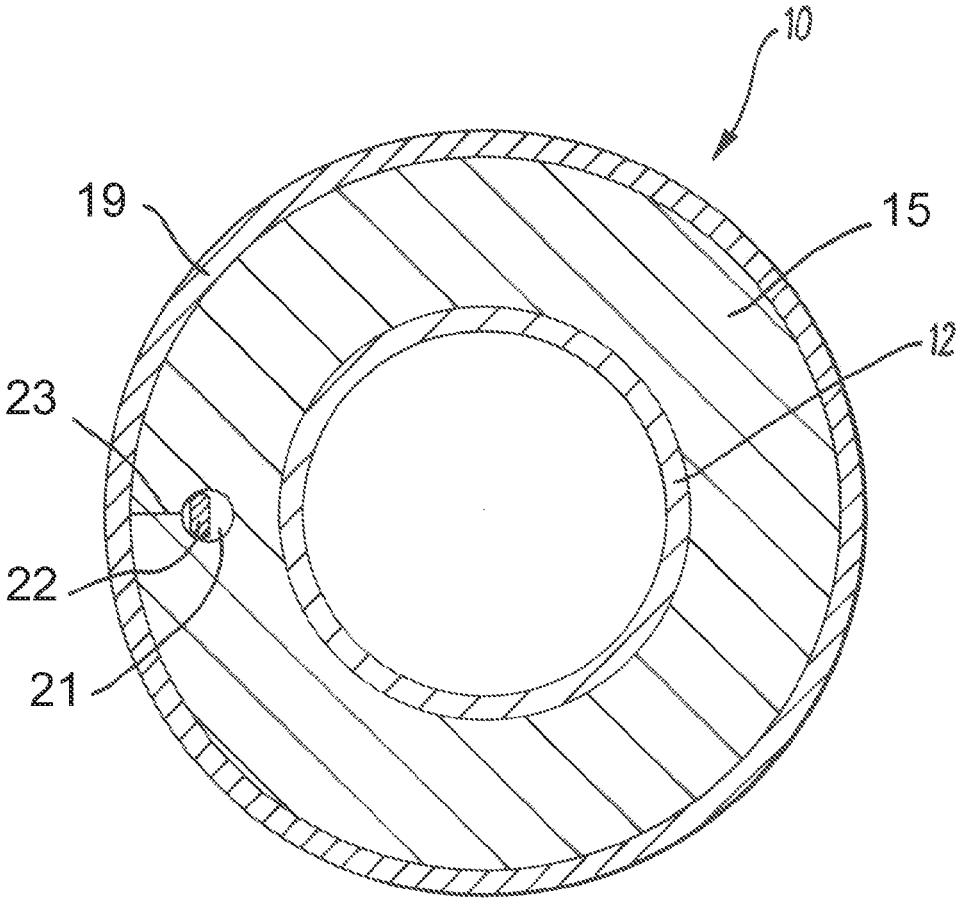
FIG. 1 (Prior Art)
FIG. 1 is a cross-sectional view of a wellbore packer according to the prior art.
Figure 2:
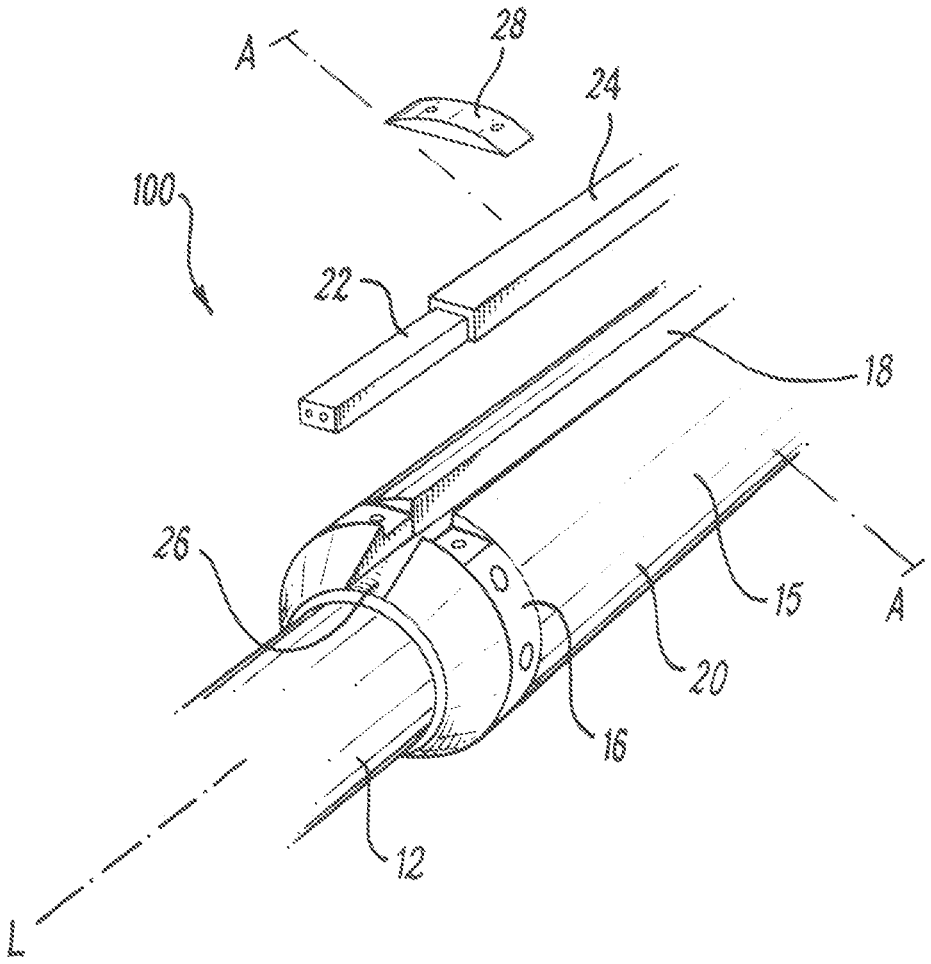
FIG. 2 is a perspective, exploded view of a wellbore packer in accordance with an embodiment of the invention.
Figure 3:
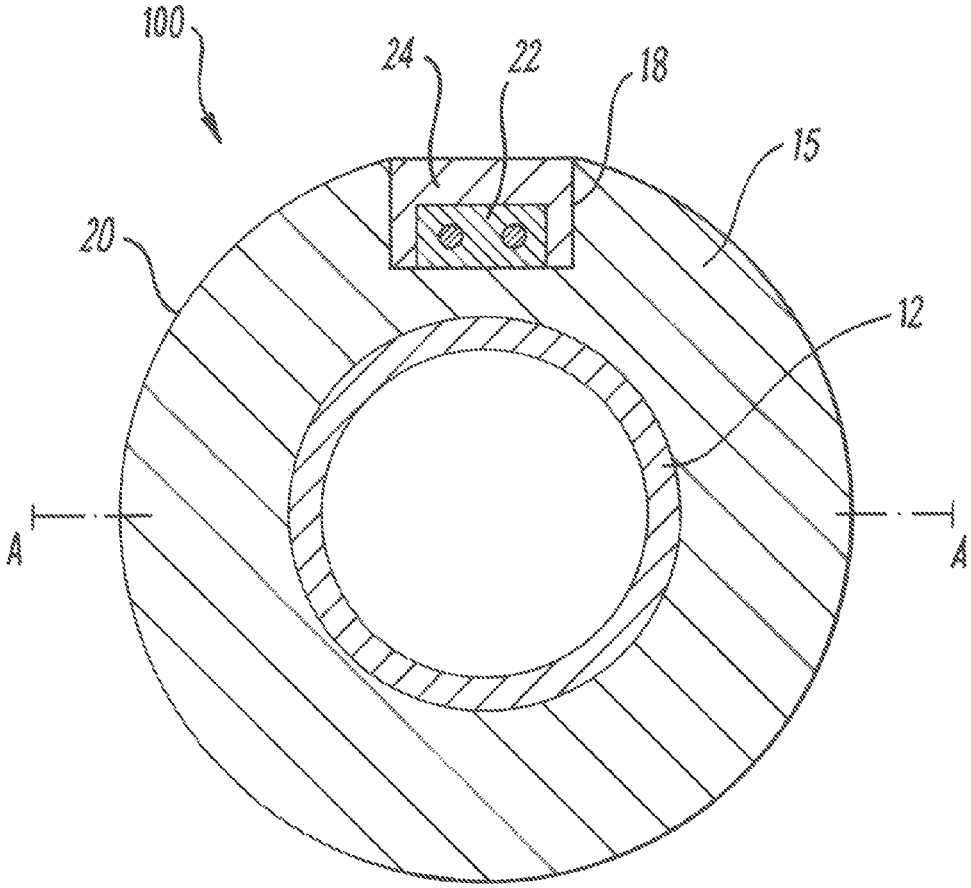
FIG. 3 is a cross-sectional view of the packer of FIG. 2 along line A-A.
Figure 4:
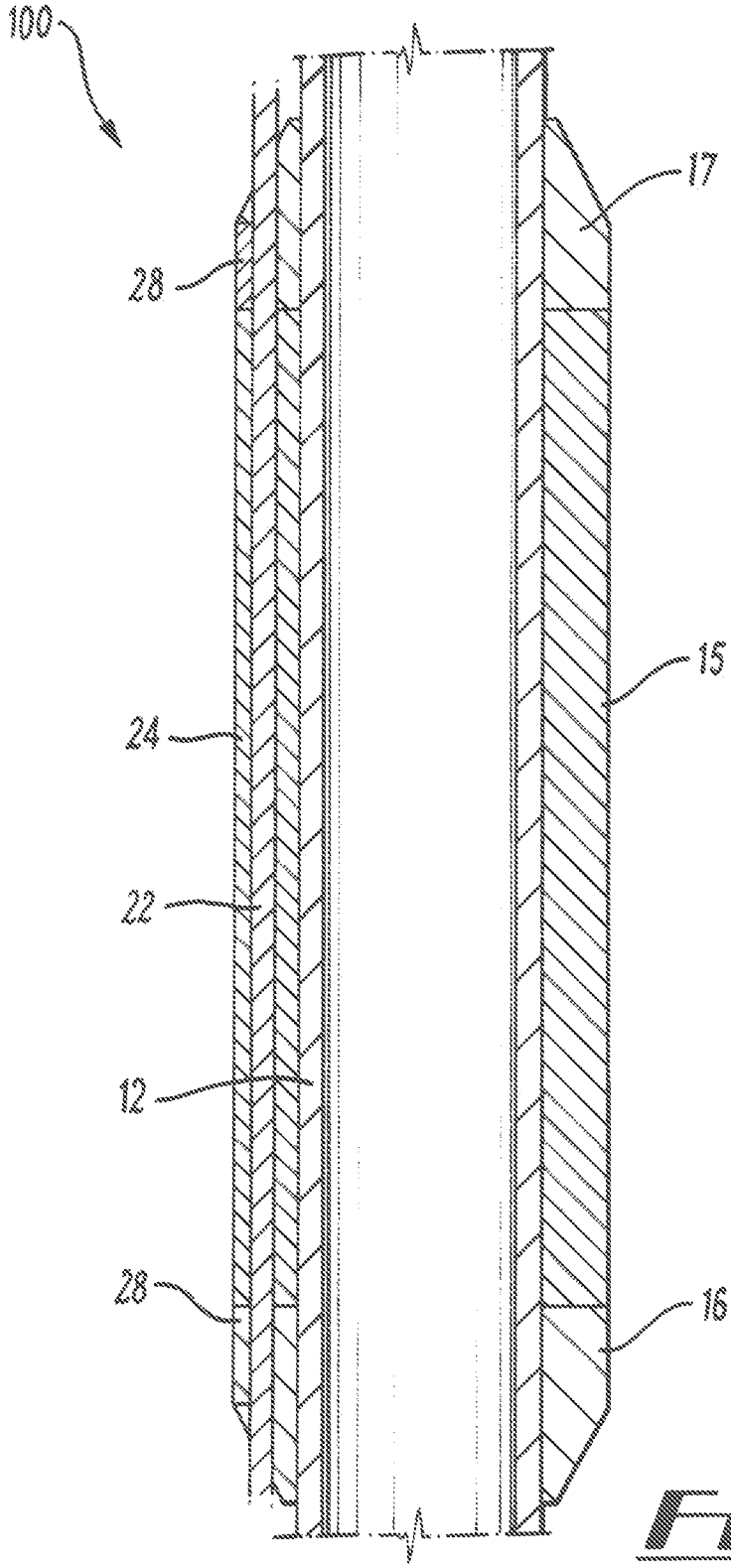
FIG. 4 is a longitudinal sectional view of the packer or FIG. 2.
Figure 5:
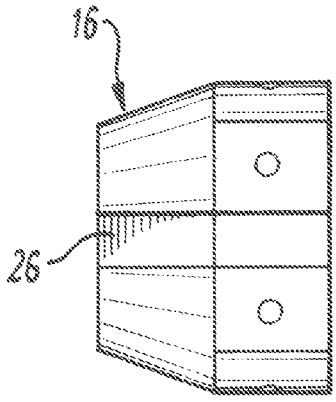
FIGS. 5 to 8 show components which forms part of the packer of FIG. 2.
Figure 6A:
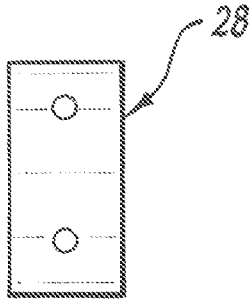
Figure 6B:
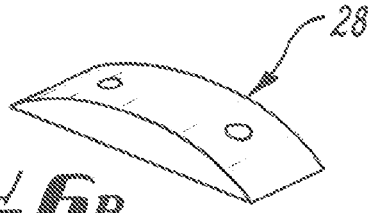
Figure 7:
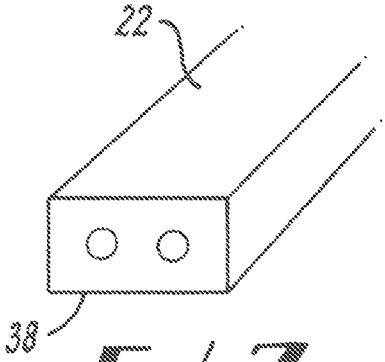

Referring to FIGS. 2 to 8 the drawings, there is shown schematically an aspect of the invention embodied as a wellbore packer, generally depicted at 100, formed on a tubular body 12 having a longitudinal axis L. The packer 100 comprises an expanding or swellable portion 15 of cylindrical form located around the body 12 and a pair of end rings 16, 17 located respectively at opposing ends of the swellable portion 15. The swellable portion 15 is formed from a material selected to expand on exposure to at least one predetermined fluid. In this embodiment, the swellable material is ethylene propylene diene monomer (EPDM), selected to increase in volume on exposure to a hydrocarbon fluid. Other suitable materials are known to those skilled in the art of swellable downhole tools. The functions of the end rings 16, 17 include: providing stand-off and protection to the packer 100 and the tubular 12, axially retaining the swellable portion 15, and mitigating extrusion of the expanding portion 15 in use.

The swellable portion is provided with a formation 18 which is open to the outer longitudinal surface 20 of the swellable portion. The formation 18 is open in the unswelled condition of the packer 100, and is formed by milling an open slot in the surface 20 of the swellable portion 15. The formation 18 is sized to provide a pathway for a cable or line, which may for example be a control line, fluid conduit, electrical cable or optical fibre bundle. In this embodiment, the cable 22 is coupled to an insert 24, which is formed from a swellable material of similar properties to the material making up the swellable portion 15. In this example, the insert is formed from an EPDM rubber, and increases in volume on exposure to a hydrocarbon fluid. The insert 24 is sized to create an interference fit with the formation 18.

The end rings 16, 17 are provided with recesses 26, which are aligned with the formation 18 to provide a continuous pathway for the cable 22. A retaining section 28 fits over the cable 22 in a machined section of the end ring to retain the cable position. In alternative embodiments, retaining clamps may be provided at intervals along the length of the packer 100.

Figure 8:
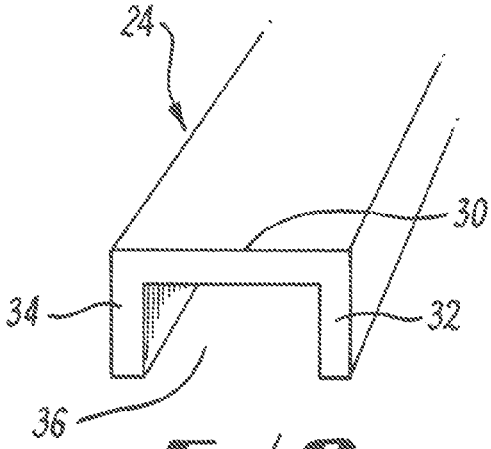

As most clearly shown in FIG. 8, the insert 24 is elongated and comprises a main body 30 and a pair of side walls 32, 34, which together define a substantially u-shaped profile. The recess 36 defined by the insert 24 is dimensioned to receive the cable 22. In this embodiment, the lowermost surface 38 of the cable 22 lies flush with the edges of the side walls 32, 34. The insert is extruded from EPDM, selected to increase in volume on exposure to a hydrocarbon fluid.

In use, the swellable portion 15 is formed on the body, and the formation 18 is machined. Conveniently, the formation 18 may be machined to a standard size, to which the outer dimensions of the insert 24 are formed. Indeed, the insert 24 may be selected according to the cable or line to be fed through the packer. For example, a variety of inserts, all with standardised outer dimensions but differing internal profiles, may be available at the construction location. The correct insert can be selected to fit with the particular cable or line, without necessitating any change to the size of the formation. Thus the same formation 18 size can be used to accommodate a variety of sizes of cable or line.

The cable 22 is bonded to the insert, for example using a cyanoacrylate-based adhesive. Other bonding agents are suitable, including polyurethane-based adhesives, acrylic-based adhesives, epoxy-based adhesives or silicone-based adhesives or sealants.

The combined insert and cable is then inserted into the formation 18, and bonded in place, again using a cyanoacrylate-based or other suitable adhesive. The retaining portions 28 are then secured to the end rings using bolts (not shown).

Figure 9:
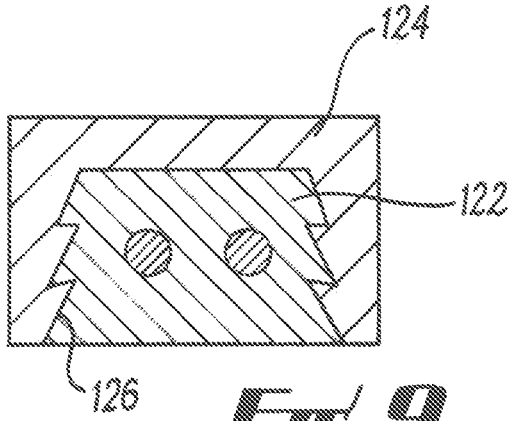
FIGS. 9 to 11 are cross-sectional views of insert and cable assemblies in accordance with alternative embodiments of the invention.
Figure 10:
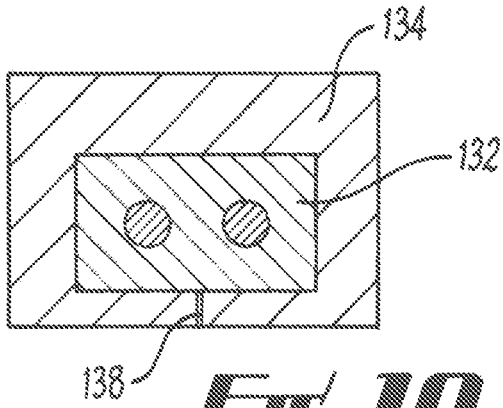
Figure 11:
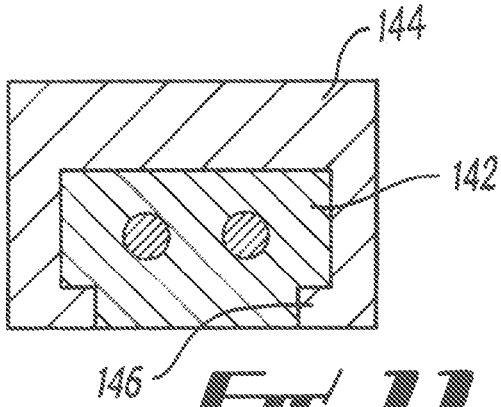

FIGS. 9 to 11 show alternative embodiments of the invention having different insert and/or cable profiles. FIG. 9 shows a cable 122 and insert 124 having corresponding engaging profiles 126. The resilient nature of the insert material functions to retain the insert and cable together, which may remove the requirement for bonding.

FIG. 10 shows a cable 132 and insert 134 which encloses the cable on its lowermost surface 136. The cable is located in the insert via opening 138. The resilient nature of the insert material functions to close the opening and retain the insert and cable together.

FIG. 11 shows an alternative embodiment in which the side walls of the insert 144 comprise retaining formations 146 which correspond to formations provided in the cable 142.

Figure 12:
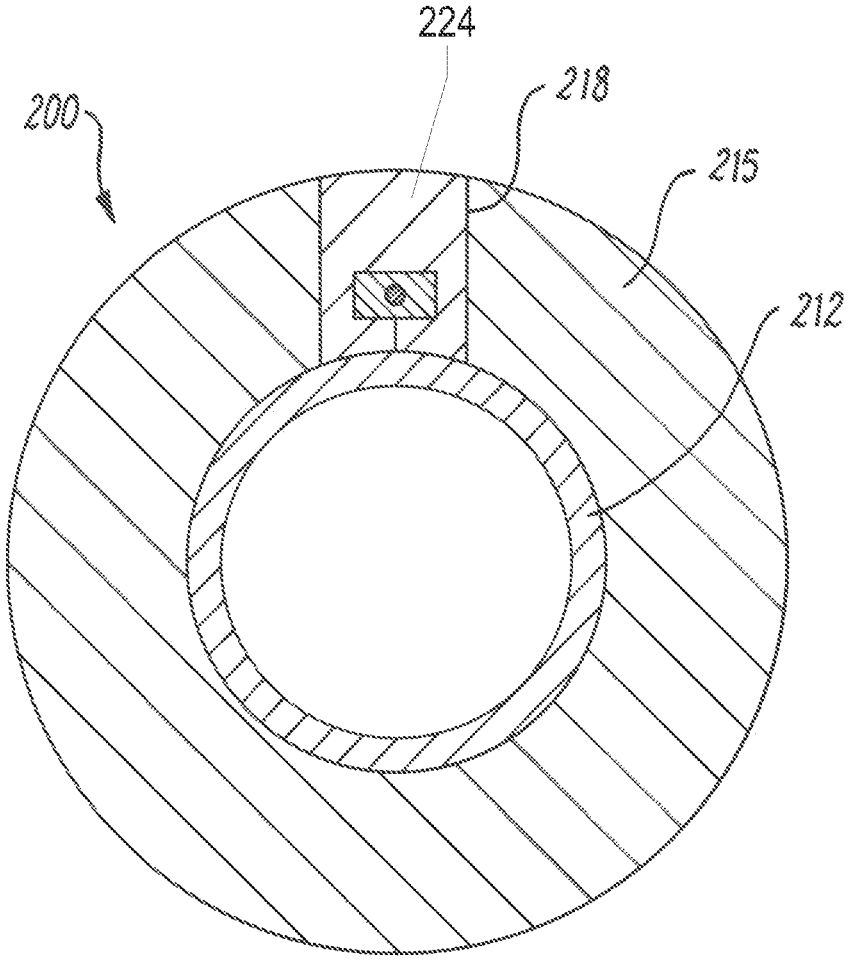
FIGS. 12 to 14 are cross-sectional views of packers according to alternative embodiments of the invention.
Figure 13:
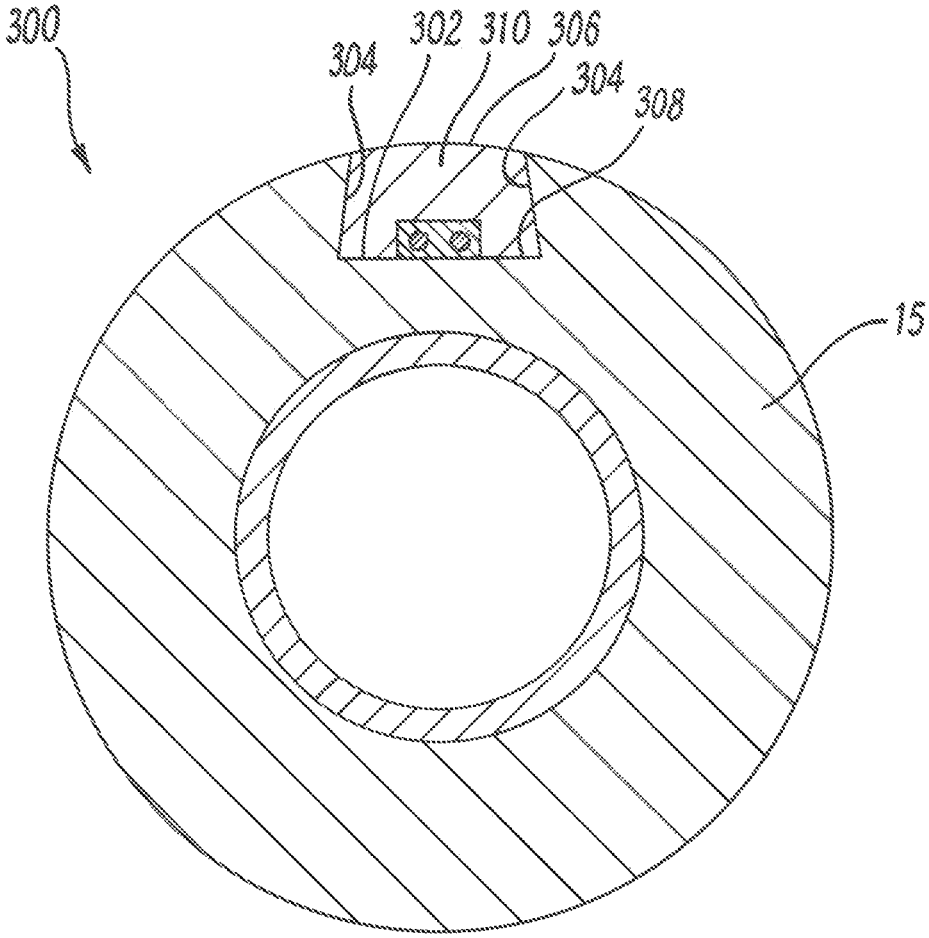
Figure 14:
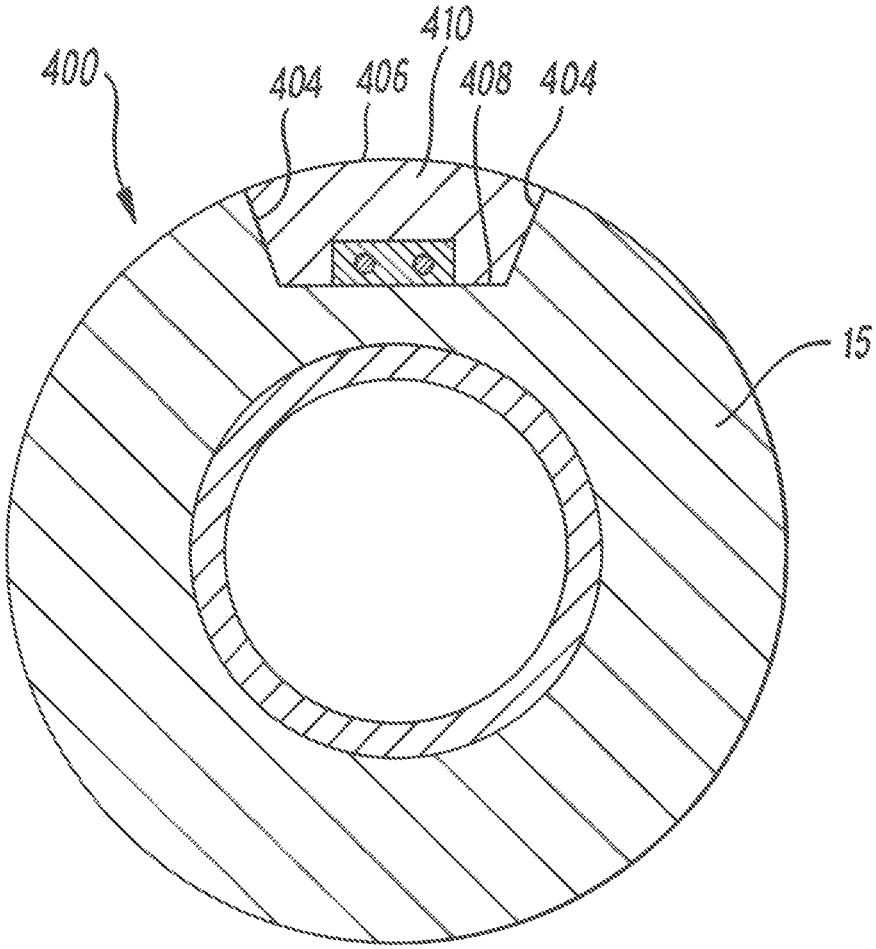

FIGS. 12 to 14 are cross-sectional views of further alternative embodiments of the invention. FIG. 12 shows a packer 200 in which the formation 218 in swellable portion 215 is formed to the base pipe. The insert 224 is similar to insert 134 of FIG. 10, but is dimensioned to fit the depth of the formation 218.

In the embodiment of FIG. 13, the packer 300 has a formation 302 with sidewalls 304 are angled inwardly such that the opening 306 of the formation is narrower than the base 308 of the insert 310. The sidewalls of the insert 308 are correspondingly angled. This facilitates retention of the insert in the formation.

In the embodiment of FIG. 14, the packer 400 has a formation 402 with sidewalls 404 which are angled outwardly such that the opening 406 of the formation is wider than the base 408 of the insert 410. The sidewalls of the insert 308 are correspondingly angled. This facilitates location of the insert into the formation.

Figure 15:
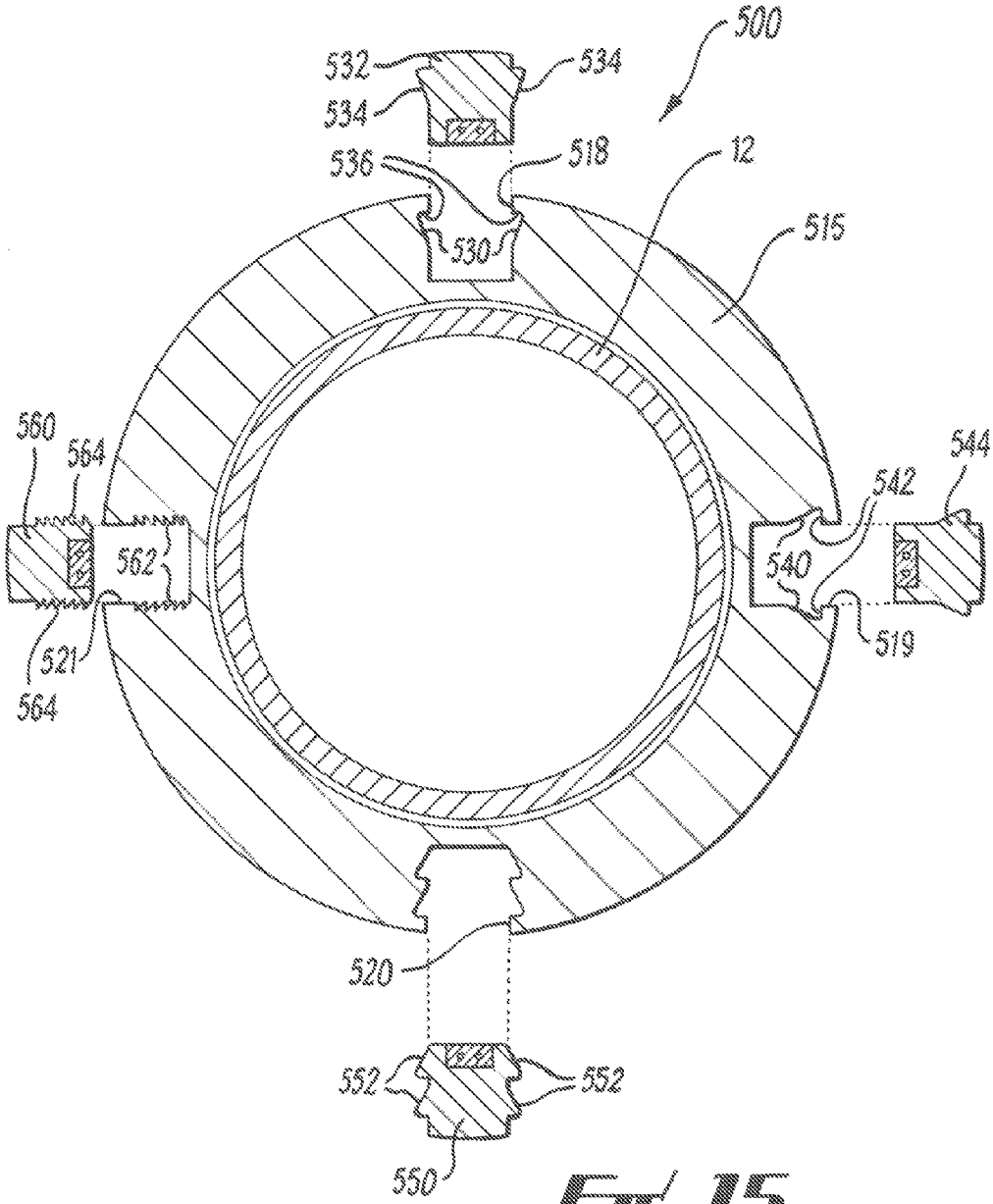
FIG. 15 is a schematic cross-sectional view showing cross sectional profiles of recesses which may be used with embodiments of the invention.

In alternative embodiments, engaging portions may be formed between the swellable portion and the insert, as described with reference to FIG. 15. FIG. 15 is a cross section through a packer 500, similar to the packer 100 described with reference to FIGS. 2 to 4. The packer 500 comprises a swellable portion 515 located around a tubular body 12. As with the previous embodiments, the swellable portion 515 is formed from a material such as EPDM, selected to increase in volume on exposure to the hydrocarbon fluid. The swellable portion 515 is provided with formations 518, 519, 520 and 521, shown circumferentially spaced on the body. In this embodiment, multiple formations are formed on the swellable portion, although in alternative arrangements the swellable portion may comprise only one formation. Any number of formations may be provided in the swellable portion within the scope of the invention.

Formations 518, 519, 520, 521 are open longitudinal recesses formed in the outer longitudinal surface of the swellable portion 515. The formations are formed to a depth of around 85% of the depth of the swellable portion. It has been found that at a formation depth of approximately 80% to 90% of the depth of the swellable portion uniform swelling can be achieved without adversely affecting the sealing capability of the packer. The formation 518 is substantially square in profile, but includes a pair of engaging recesses 530 machined into the side wall of the formation 518. The width of the main recess 518 is approximately 16.1 mm, and the width at the maximum extent of the recesses 530 is approximately 19.0 mm. The shape of the recesses 530 corresponds to the profile of the inserts 532, which includes outwardly protruding ridges 534 formed to the shape of the recesses. The lower edge of the recesses is angled with respect to the side wall of the formation, and in this example the angle is approximately 15 degrees to the side wall of the formation. The formations provided on the insert have a corresponding angle. This facilitates radial placement of the insert into the formation 518. The upper surface of the recess provides a retaining abutment surface 536 for the corresponding surface on ridges 534.

The edges of the recesses and inserts are rounded, which reduces the tendency of the side walls of the formation to collapse during insertion of the insert. In this embodiment, the engaging portions are longitudinally formed and extend along the length of the formation and insert, but in other embodiments they may only be provided at discrete locations along their lengths.

Formation 519 is similar to formation 518, although it is provided with a pair of recesses 540 in the side wall of the formation with a maximum width greater than that of formation 518. This provides a larger abutment surface 542, and therefore greater retaining forces of the insert 544 in the formation. In this example, the maximum width of the recesses is around 22.2 mm, and the angle of the lower surface of the recess (and the corresponding surface of the insert) is approximately 30 degrees to the side wall of the formation.

Formation 520 is similar to the formation 519, but comprises two pairs of recesses in the side walls of the formation. The maximum width of the recesses is approximately 21.0 mm. The insert 550 has a corresponding profile, and thus provides two pairs of ridges 552 extending outwardly from the side wall of the insert. Two pairs of abutment surfaces are provided for retaining the insert in the formation.

Formation 521 is similar to the recesses 518, 519, having a substantially square cross section of profile formed to a width of approximately 16.1 mm. However, the formation 520 differs in that it is provided with multiple recesses 562 formed in its side wall surfaces which form a number of grooves corresponding to ridges 564 formed in the outer surface of the insert 560. This arrangement provides a larger surface area of contact between the ridges on the insert and the grooves in the formation. This allows the maximum width of the recessed portions of the formation 521 to be reduced, compared to other embodiments having fewer grooves. In this example, the maximum width is around 19.1 mm. This may facilitate insertion of the insert 560 into the recess 521, because the recesses and grooves require less deformation.

Although the embodiment of FIG. 15 shows a packer having multiple formations with different cross-sectional profiles, the insert and formation profiles may be identical in any given packer arrangement. Alternatively, any combination of formation and insert profiles may be used within the scope of the invention.

By providing recesses in the formation and ridges in the insert, the surface area of contact between the respective components is increased, which improves bonding and frictional retention due to swelling. The arrangements also provide abutment surfaces which resist radial separation of the respective components. This does however require deformation of the insert and/or the swellable portion to allow the insert to be received properly in the formation. In order to facilitate this, embodiments of the invention may include a selection of materials for the insert and/or the swellable material which allow an appropriate degree of deformation, whilst still having the required integral strength and retention forces necessary for functioning of the packer. For example, the material of the insert may be an EPDM rubber, selected to increase in volume on exposure to hydrocarbon fluid, having a hardness or rigidity which is greater than the hardness or rigidity of the swellable portion. This facilitates ease of assembly, which can involve applying large forces to the insert to drive the insert into the formation. The edges of the formation resiliently deform to allow the location of the insert, and subsequently to retain the insert in the formation.

Alternatively, the hardness of the swellable portion (or a part of it around the opening) may be greater than the hardness of the material selected for the insert. Thus on insertion of the insert into the formation, the ridges on the insert will tend to resiliently deform to allow proper location in the formation.

Hardness variations can be achieved in a number of different ways known to those skilled in the art of elastomeric materials, including for example by varying the cross-linking density in the rubber. Alternatively, the compositions of the elastomers may vary; in terms of the proportions of constituent materials, or in the chemical composition of the elastomer itself.

Typical hardness values for the rubbers used with the invention are around 60 to 80 on the Shore A scale. The materials for the swellable portion and the insert may be selected such that their hardness differs by up to 20 hardness points on the Shore A scale. In a preferred embodiment, the material for the swellable portion has a Shore A hardness of 55 to 75, and the hardness of the insert is higher, and in the range of 65 to 85 on the Shore A scale.

Although the embodiment of FIG. 15 shows a packer having formations with different cross sectional profiles, insert and formation profiles may be identical in any given packer arrangement. Alternatively, any combination of formation and insert profiles may be used within the scope of the invention.

The process of forming the packer offers several advantages. Firstly, the open formation is more straightforward to form than the slit and opening of the prior art, meaning that specialist equipment is not required.

With embodiments of the present invention, material that is removed from the packer is replaced by an equivalent volume of material or cable, control line, wire etc. and the whole assembly may be firmly bonded into place with a bonding agent that has the same or greater integral strength as the original rubber before going in the hole.

The present invention can be applied to a variety of packers at any time and can be applied to a range of proprietary packers. The formation need not be formed until after the packer has been manufactured. This means that a standard packer can become a cable feedthrough packer after original manufacture. The process can effectively be reversed by inserting and bonding a blank insert into the formation.

The present invention does not rely on the cutting of the formation or slit to determine the cable size(s) for the specific application. An operator is therefore able to alter the required cable size after manufacturing by changing the size of the inner profile of the insert. This gives versatility when coupled with the additional capability to machine the groove(s) once the packers have been manufactured.

The invention allows end users to delay the decision on when and if they need a cable feedthrough capability until a time close before the deployment of the packer. Formations can be machined locally or at the manufacturing centre and the correct insert applied for the cable sizes used.

The present invention relates to apparatus for use downhole, an assembly, a method of forming a downhole apparatus, and methods of use. The apparatus of the invention may be conveniently used in isolation tools and systems, in cased and uncased holes. The invention provides cable feedthrough capabilities for isolation tools and packers which may be manufactured and assembled more efficiently than in the case of the prior art, and which are flexible in their application to a variety of wellbore scenarios.

It will be appreciated by one skilled in the art that the invention is applicable to packers formed on tubulars, mandrels, or packing tools which are run on wireline. In addition, the present invention has application to which extends beyond conventional packers. The invention may be particularly valuable when applied to couplings and joints on tubulars and mandrels. The invention can also be applied to coiled tubing, for use in drilling or intervention operations.

The present invention provides an apparatus and assembly for creating a seal in a wellbore around a cable or line. The assembly includes a longitudinal body and a swellable portion which comprises a material selected to increase in volume on exposure to at least one triggering fluid. The swellable portion has a formation open to the longitudinal surface which provides a pathway for a cable or line to extend through the swellable portion, and an insert of swellable material. In an embodiment of the invention, the insert partly or fully encloses or encapsulates the cable or line. An aspect of the invention is characterised by the provision of a formation which is open to an outer longitudinal surface of the body.

Variations to the above described embodiments are within the scope of the invention, and combinations of features other than those expressly stated form part of the invention. Unless the context requires otherwise, the physical dimensions, shapes, internal profiles, end rings, and principles of construction described herein are interchangeable and may be combined within the scope of the invention. Additionally, although the invention is particularly suited to downhole use it may also be used in topside and subsea applications such as in pipeline systems.

What is claimed is:

1. An assembly for creating a seal in a wellbore, the assembly comprising:

a longitudinal body;

a swellable portion formed on the longitudinal body, the swellable portion comprising a material selected to expand on exposure to at least one predetermined fluid and having a formation which provides a pathway for a cable or line to extend through the swellable portion; and an insert located in the formation, the insert comprising a material selected to swell on exposure to at least one predetermined fluid, wherein the insert at least partially encloses the cable or line in use, and wherein the insert encloses the cable or line on the innermost surface of the cable or line.

2. The assembly as claimed in claim 1, wherein the insert is configured to create a seal between the pathway for the cable or line and a surface of the wellbore.

3. The assembly as claimed in claim 1, wherein the insert is configured to provide a seal between the cable or line and the swellable portion.

4. The assembly as claimed in claim 1, wherein the insert is configured to provide a seal between the cable or line and a longitudinal body of the apparatus.

5. The assembly as claimed in claim 1, wherein the insert and the formation together define the pathway for the cable or line through the swellable portion.

6. The assembly as claimed in claim 1, wherein the insert is provided with a channel for receiving a cable or line.

7. The assembly as claimed in claim 6, wherein the channel is accessible from a longitudinal edge of the insert.

8. The assembly as claimed in claim 6, wherein the channel is dimensioned for an interference fit with a cable or line.

9. The assembly as claimed in claim 1, wherein the insert is configured to be coupled to the cable or line.

10. The assembly as claimed in claim 1, wherein the insert is provided with engaging portions for coupling to the cable or line to form a combined insert and cable or line, prior to location of the combined insert and cable or line in the formation.

11. The assembly as claimed in claim 1, wherein the insert comprises a clip-on member that clips around the cable or line.

12. The assembly as claimed in claim 1, wherein the insert is formed to a length substantially equal to the length of the swellable portion.

13. The assembly as claimed in claim 1, wherein the insert further comprises a substantially rectangular outer profile.

14. The assembly as claimed in claim 1, wherein the outer profile of the insert is dimensioned to be an interference fit with the formation of the swellable portion.

15. The assembly as claimed in claim 1, wherein the insert is formed from a material selected to have substantially the same swelling characteristics as the swellable portion.

16. The assembly as claimed in claim 1, wherein the insert is formed from a material selected to differ from the material selected for the swellable portion in one or more of the following characteristics: fluid penetration, fluid absorption, swelling coefficient, swelling rate, elongation coefficient, hardness, resilience, elasticity, and density.

17. The assembly as claimed in claim 16, wherein the insert comprises a material that has a hardness characteristic which differs from a hardness characteristic of the material selected for the swellable portion.

18. The assembly as claimed in claim 17, wherein the insert comprises a material which is harder than the material of the swellable portion.

19. The assembly as claimed in claim 1, wherein the insert and the swellable portion comprise corresponding engaging portions.

20. The assembly as claimed in claim 19, wherein the engaging portions comprise at least one set of cooperating ridges and grooves which is longitudinal to the formation and the insert.

21. The assembly as claimed in claim 20, wherein the ridges are provided on the insert, and the grooves are provided in the formation.

22. A method of forming an assembly for use in a wellbore, the method comprising the steps of:

providing a swellable portion on a longitudinal body, the swellable portion comprising a material selected to expand on exposure to at least one predetermined fluid;

providing an open formation in a longitudinal surface of the swellable portion;

locating a cable or line in the formation such that the cable or line extends through the swellable portion; and locating an insert in the formation, the insert comprising a material selected to expand on exposure to at least one predetermined fluid, wherein the insert at least partially encloses the cable or line, and wherein the insert encloses the cable or line on the innermost surface of the cable or line.

23. The method as claimed in claim 22, including the further step of coupling the insert to the cable or line.

24. The method as claimed in claim 22, including the further step of locating the cable or line in a longitudinal channel formed in the insert.

25. The method as claimed in claim 22, including the further steps of coupling the insert and the cable or line and subsequently locating the combined insert and cable or line in the formation.

26. The method as claimed in claim 22, further comprising the step of locating the cable or line or insert in the formation from an outer longitudinal surface of the swellable portion.

27. The method as claimed in claim 22, further comprising the step of securing the insert in the formation.

28. The method as claimed in claim 27, wherein the insert is secured in the formation by a bonding agent.

29. The method as claimed in claim 27, wherein the insert is secured in the formation by a mechanical attachment.

30. The method as claimed in claim 29, wherein the insert is clamped into the formation.

31. A method of forming a seal in a downhole environment, the method comprising the steps of:

providing an assembly as claimed in claim 1;

running the assembly to a downhole location; and exposing the assembly to at least one wellbore fluid to expand the swellable portion and the insert to create a seal around a cable or line.

32. An apparatus for creating a seal in a wellbore, the apparatus comprising:

a swellable portion comprising a material selected to expand on exposure to at least one predetermined fluid, the swellable portion comprising:

a formation open to a longitudinal surface which provides a pathway for a cable or line to extend through the swellable portion, wherein the formation is configured to receive an insert comprising a material selected to swell on exposure to a predetermined fluid, wherein the insert at least partially encloses the cable or line, and wherein the insert encloses the cable or line on the innermost surface of the cable or line.

33. The apparatus as claimed in claim 32, wherein the formation is a recessed channel dimensioned to be an interference fit with the insert.

34. The apparatus as claimed in claim 32, wherein the formation comprises a substantially rectangular profile.

35. The apparatus as claimed in claim 32, wherein the formation is open to an outer surface of the swellable portion.

36. The apparatus as claimed in claim 32, wherein the formation comprises engaging portions corresponding to engaging portions formed on the insert.

37. The apparatus as claimed in claim 36, wherein the engaging portions comprise at least one ridge or groove longitudinal to the formation.

38. The apparatus as claimed in claim 37, wherein the engaging portions comprise at least one groove longitudinal to the formation corresponding to at least one ridge provided on the insert.

39. An insert comprising a material selected to swell on exposure to a predetermined fluid and configured to be located in the formation of the apparatus of claim 32.

* * * * *